United States Patent [19]

Margulies

[11] Patent Number: 4,526,291

[45] Date of Patent: Jul. 2, 1985

[54] DISPENSING PACKAGE FOR CONTAINING AND DISPENSING ARTICLES

[75] Inventor: Herman Margulies, South Orange, N.J.

[73] Assignee: Sterling Drug Inc., New York, N.Y.

[21] Appl. No.: 495,228

[22] Filed: May 16, 1983

[51] Int. Cl.[3] ..... A47K 10/24

[52] U.S. Cl. ..... 221/63; 221/64; 206/409

[58] Field of Search ..... 221/63, 64; 222/502, 222/528; 206/205, 210, 409; 383/33, 34, 78, 96, 906; 220/254, 339, 375

[56] References Cited

U.S. PATENT DOCUMENTS

| | | | |
|---|---|---|---|
| 755,085 | 3/1904 | Viano | 383/34 X |
| 2,343,064 | 2/1944 | Kjorsvik | 312/39 |
| 3,458,080 | 7/1969 | Laurizio | 220/27 |
| 3,484,016 | 12/1969 | Turner | 220/60 |
| 3,486,665 | 12/1969 | La Croce | 222/480 |
| 3,495,746 | 2/1970 | Laurizio | 222/541 |
| 3,749,296 | 7/1973 | Harrison | 225/106 |
| 3,784,055 | 1/1974 | Anderson | 221/46 |
| 3,841,466 | 10/1974 | Hoffman et al. | 206/205 |
| 3,843,017 | 10/1974 | Harrison | 221/63 |
| 3,845,872 | 11/1974 | Towns et al. | 215/9 |
| 3,868,052 | 2/1975 | Rockefeller | 225/106 |
| 3,881,639 | 5/1975 | Herip | 222/153 |
| 3,899,285 | 8/1975 | Christmas | 431/152 |
| 3,908,857 | 9/1975 | Chiappe | 220/359 |
| 3,967,756 | 7/1976 | Barish | 221/45 |
| 3,982,659 | 9/1976 | Ross | 221/63 |
| 3,986,479 | 10/1976 | Bonk | 118/506 |
| 3,990,603 | 11/1976 | Brochman | 220/260 |
| 3,994,417 | 11/1976 | Boedecker | 221/48 |
| 4,017,002 | 4/1977 | Doyle et al. | 221/63 |
| 4,047,495 | 9/1977 | O'Brian | 215/224 |
| 4,185,754 | 1/1980 | Julius | 221/63 |
| 4,344,545 | 8/1982 | Aschberger et al. | 220/307 |

OTHER PUBLICATIONS

"Diaparene Baby Wash Clothes" Dispenser.

*Primary Examiner*—Joseph J. Rolla
*Assistant Examiner*—Michael S. Huppert
*Attorney, Agent, or Firm*—Wenderoth, Lind & Ponack

[57] ABSTRACT

A flexible bag is adapted to contain articles to be dispensed, and the bag has a closed first end and open second end. A collar is fixed to the open second end of the bag. A top has therein a dispensing opening and a slit connected with the dispensing opening. The top is selectively movable between a first position fitted to the collar and a second position removed from the collar. A lid is selectively movable between a first position covering at least a portion of the top and a second position removed from the top. The lid includes a first portion adapted to cover the dispensing opening when the lid is in the first position thereof and a second portion adapted to cover the slit when the lid is in the first position thereof. The second portion of the lid is integrally but flexibly connected to the first portion of the lid, such that when the lid is in the first position thereof the second portion of the lid may be selectively pivoted with respect to the first portion of the lid away from the top, thereby to uncover the slit.

26 Claims, 5 Drawing Figures

DISPENSING PACKAGE FOR CONTAINING AND DISPENSING ARTICLES

BACKGROUND OF THE INVENTION

The present invention relates to a dispensing package for containing and dispensing articles, and to a closure unit for use with such a dispensing package.

More particularly, the present invention relates to such a package and closure unit for use with towels or tissues, for example towels or tissues which are joined by interlocking, or which are in the form of a continuous web with individual towels being separably connected by perforations.

The present invention specifically represents an improvement of the present Applicant's pending U.S. Pat. No. 4,462,507. Such patent discloses a dispensing closure for closing an end of a canister containing dispensable articles, such closure including a top adapted to fit over an open end of a canister, such top having depending therefrom an integral peripheral axial flange adapted to fit and position the top on the canister, the top having therein a dispensing opening and a slit connected with such dispensing opening. A lid is selectively movable between a first position covering at least a portion of the top and a second position removed from the top. The lid includes a first portion adapted to cover the dispensing opening when the lid is in the first position thereof. The lid includes a second portion adapted to cover the slit when the lid is in the first position thereof. The second portion of the lid is integrally but flexibly connected to the first portion of the lid, such that when the lid is in the first position thereof the second portion of the lid is selectively pivotable with respect to the first portion of the lid away from the top, thereby to uncover the slit. The inventions disclosed in such patent make it possible to substantially completely isolate the interior of the container or canister from the surrounding atmosphere prior to purchase and use by a consumer. Such inventions make it possible to thread a first towel through the dispensing opening and thereafter to rethread a towel through the dispensing opening if such threading is interrupted, without the necessity of removing the dispensing closure from a canister or container containing the towels. It is possible to maintain the interior of the container or canister substantially isolated from the surrounding atmosphere, even when the towels are being dispensed.

SUMMARY OF THE INVENTION

It is the object of the present invention to provide a dispensing package and closure unit for such dispensing package which represent improvements over the inventions disclosed in such patent.

It is a more specific object of the present invention to provide such a dispensing package which includes a flexible bag into which may be loaded articles to be dispensed, such as premoistened towels.

It is a further specific object of the present invention to provide such a dispensing package and closure unit for use therewith which particularly are adapted to be fit into a purse or pocket of a consumer.

The above objects are achieved in accordance with one aspect of the present invention by the provision of a closure unit for a dispensing package of the type for containing and dispensing articles, such closure unit including a collar adapted to be fixed to an open end of a bag adapted to contain articles to be dispensed, a top having therein a dispensing opening and a slit connected with such dispensing opening, the top being selectively movable between a first position fitted to the collar and a second position removed from the collar, and a lid selectively movable between a first position covering at least a portion of the top and a second position removed from the top. The lid includes a first portion adapted to cover the dispensing opening when the lid is in the first position thereof and a second portion adapted to cover the slit when the lid is in the first position thereof. The second portion of the lid is integrally but flexibly connected to the first portion of the lid, such that when the lid is in the first position thereof the second portion of the lid is selectively pivotable with respect to the first portion of the lid away from the top, thereby to uncover the slit.

In accordance with another aspect of the present invention, there is provided a dispensing package for containing and dispensing articles, such package including a flexible bag adapted to contain articles to be dispensed, such bag having a closed first end and an open second end, and such bag being fixed at the open second end thereof to the collar of the closure unit.

The collar may be fixed to the bag by an adhesive or by heat sealing.

In accordance with a preferred embodiment of the present invention, the top includes a top wall having therein a recess defined by a bottom wall and a side wall joining the bottom wall to the top wall, the dispensing opening and slit being in the bottom wall, and the lid fitting into such recess when in the first position thereof. The first and second portions of the lid have depending therefrom integral flanges which abut the bottom wall of the recess and which fit, for example by a friction fit, with the side wall when the lid is in the first position thereof. The first portion of the lid has depending therefrom an integral projection which tightly abuts the bottom wall at an area thereof adjacent the juncture between the dispensing opening and the slit when the first portion of the lid is in the first position thereof. The first and second portions of the lid include outwardly extending flanges which abut the top wall of the top when the lid is in the first position thereof. The collar includes an upper outwardly extending peripheral flange and a lower inwardly extending peripheral flange, and the top, when in the first position thereof, fits into the collar with the top wall of the top abutting the upper flange of the collar, with the bottom wall of the top abutting the lower flange of the collar, and with the side wall of the top fitting, for example by a friction fit, with an inner surface of the collar.

In accordance with a further advantageous arrangement of the present invention, the collar, the top and the first and second portions of the lid are formed as a single integral member, for example a molded plastic element.

In accordance with a further preferred feature of the present invention, the second portion of the lid is integrally connected to the first portion of the lid by a reduced thickness portion of the lid.

In accordance with a still further preferred arrangement of the present invention, a first flexible connecting hinge is integral with the top and with the collar and connects the top to the collar, and a second flexible connecting hinge is integral with the first portion of the lid and with the top and connects the lid with the top.

In a particularly preferred contemplated usage of the package and unit of the present invention, the bag contains a web of towels, for example premoistened towels, which are separably connected by perforations. The dispensing opening has a size sufficient to enable fingers of a consumer to extend through the dispensing opening to grasp a first towel of the web of towels and then to pull such first towel toward and into the slit, and wherein the slit has a size and shape such that, upon pulling a towel outwardly of the bag and the collar through the slit, side edges of the slit apply sufficient tension on the towel being pulled through the slit to cause separation of such towel from a succeeding towel of the web of towels, whereby such succeeding web then will be partially extended through the slit.

BRIEF DESCRIPTION OF THE DRAWINGS

Other objects, features and advantages of the present invention will become apparent from the following detailed description, taken with the accompanying drawings, wherein.

DETAILED DESCRIPTION OF THE INVENTION

Figure 1:
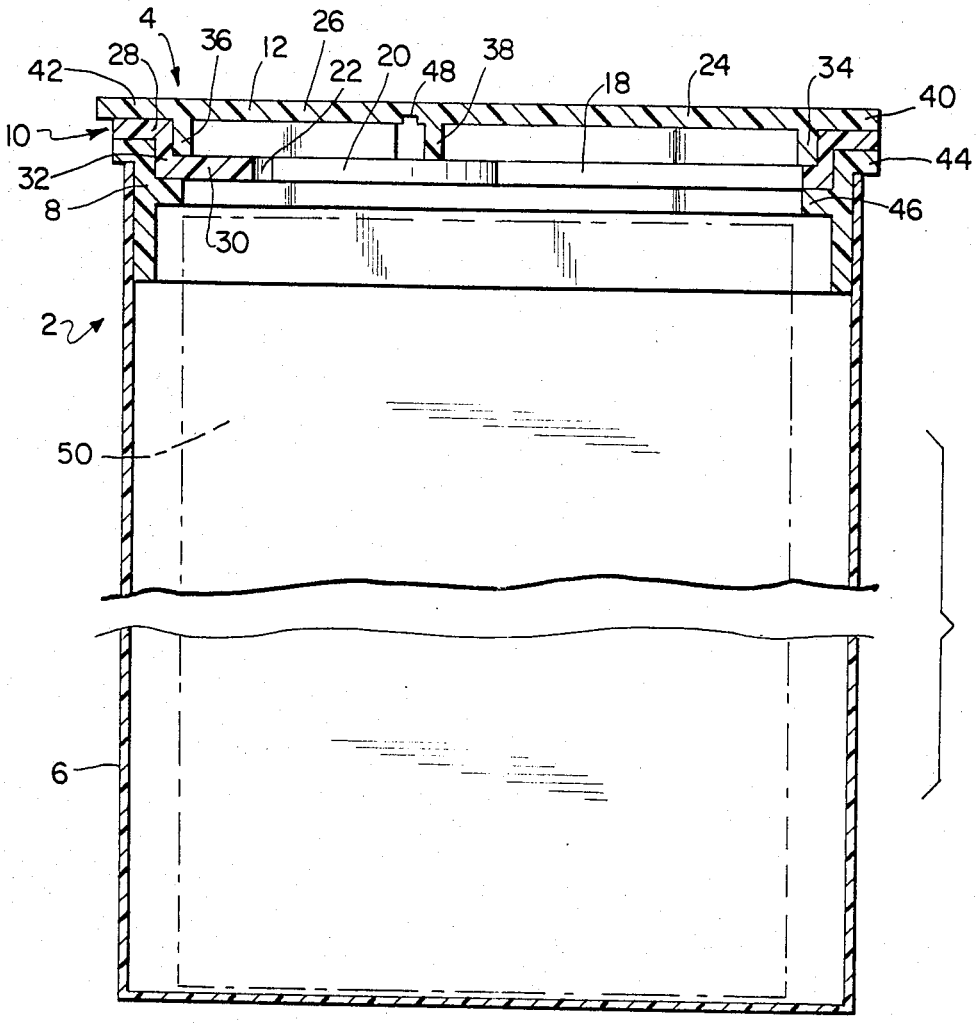
FIG. 1 is a vertical cross-sectional view taken through a major dimension of a dispensing package in accordance with a preferred embodiment of the present invention.

A dispensing package, generally indicated at 2 in FIG. 1, includes a closure unit, generally indicated at 4 in FIG. 1, and a flexible bag 6, for example a polyethylene bag. Bag 6 is sealed at the lower end as shown in FIG. 1, and has an open upper end. It is to be understood that sealing of the lower end of bag 6 may be achieved in any manner known to those in the art.

The closure unit 4 generally includes a collar 8, a top 10, and a lid 12. As indicated particularly in FIG. 5, the collar 8, top 10 and lid 12 are formed as a single integral member, for example a molded plastic element. In such arrangement, a first flexible connecting hinge 14 is integral with top 10 and collar 8 and connects top 10 to collar 8. A second flexible hinge 16 is integral with lid 12 and with top 10 and connects lid 12 with top 10.

Collar 8 is fixed to the open end of bag 6, for example as illustrated in FIG. 1 by means of an adhesive or by heat sealing. It is to be understood however that collar 8 and bag 6 may be connected by other means as will be understood by those skilled in the art.

Top 10 has formed therein a dispensing opening 18 and a slit 20 connected to dispensing opening 18. The slit 20 may have any configuration, such as those disclosed in applicant's U.S. Pat. No. 4,462,507 and in the illustrated arrangements, the end of slit 20 opposite to dispensing opening 18 is generally T-shaped, as shown at 22.

Figure 2:
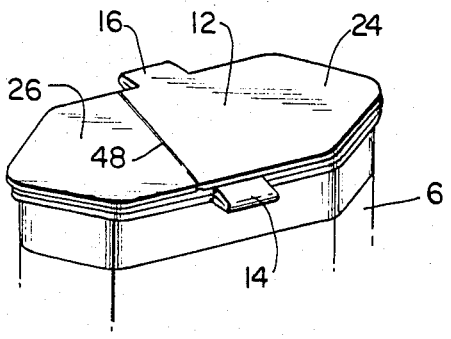
FIGS. 2 through 5 are perspective partial top views of the package of FIG. 1, with the various elements of the closure unit thereof shown in different possible operating positions and conditions thereof.
Figure 3:
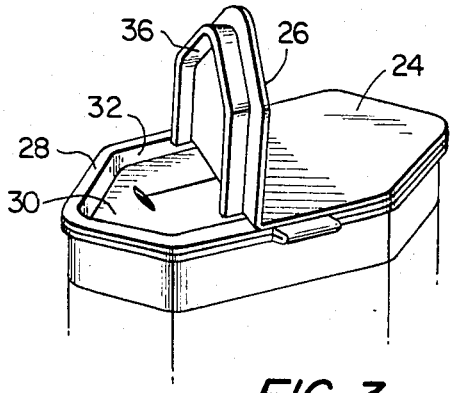
Figure 4:
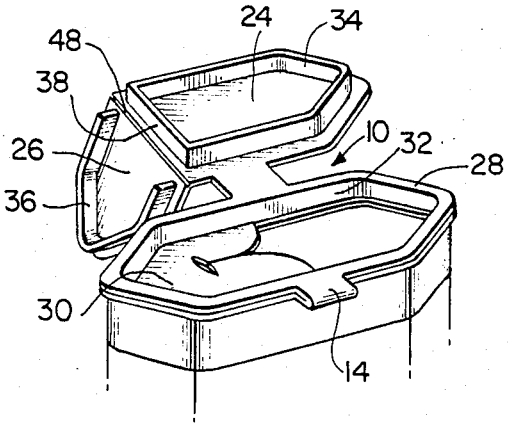
Figure 5:
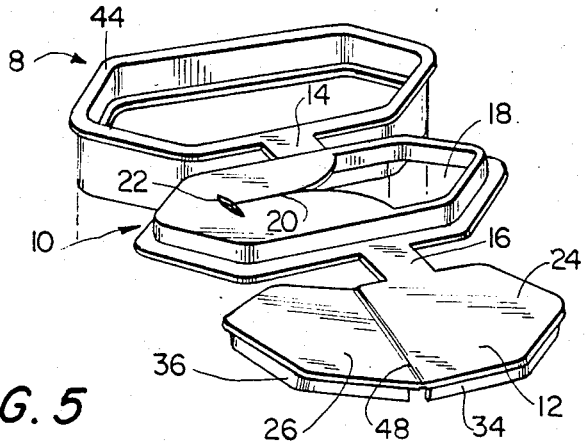

Top 10 is selectively movable, for example by the provision of flexible connecting hinge 14, between a first position, shown in FIGS. 1–4, fitted to collar 8 and a second position, shown in FIG. 5, removed from collar 8. Similarly, lid 12 is selectively movable, for example by the provision of flexible connecting hinge 16, between a first position, shown in FIGS. 1 through 3, covering at least a portion of top 10 and a second position, shown in FIGS. 4 and 5, removed from top 10. Lid 12 includes a first portion 24 adapted to cover dispensing opening 18 when lid 12 is in the first position thereof. Lid 12 further includes a second portion 26 adapted to cover slit 20, 22 when lid 12 is in the first position thereof. Second portion 26 is integrally but flexibly connected to first portion 24, such that when the lid 12 is the first position thereof the second portion 26 is selectively pivotable with respect to first portion 24 away from top 10, thereby to uncover slit 20, 22. This pivoted and uncovering condition is shown in FIG. 3 of the drawings.

Top 10 includes a top wall 28 having therein a recess defined by a bottom wall 30 and a side wall 32 joining bottom wall 30 to top wall 28. Dispensing opening 18 and slit 20, 22 are in bottom wall 30. Lid 12, when in the first or covering position thereof, fits into such recess. First and second portions 24, 26 of lid 12 have depending therefrom integral flanges 34, 36, respectively, which abut the bottom wall 30 of the recess in top 10 and which friction fit with side wall 32 when the lid 12 is in the first position thereof. The first portion 24 of lid 12 has depending therefrom an integral projection 38 which tightly abuts the bottom wall 30 at an area thereof adjacent the juncture of dispensing opening 18 and slit 20, 22, when first portion 24 is in the first or closing position thereof. Thus, when the unit is in the condition illustrated in FIG. 3, the interior of the package substantially is sealed, even with second portion 26 of lid 12 in the raised position thereof, i.e. projection 38 contacting bottom wall 30 substantially seals the dispensing opening 18 from the exterior. Furthermore, first and second portions 24, 26 of lid 12 include outwardly extending flanges 40, 42, respectively, which abut the top wall 28 of top 10 when the lid is in the first or closing position thereof, as shown in FIGS. 1 and 2. As shown in FIG. 1, the forward portion of flange 42 may extend slightly beyond the top wall 28, thereby facilitating upward pivoting of second portion 26 to uncover the slit 20, 22.

Collar 8 includes an upper outwardly extending peripheral flange 44 and a lower inwardly extending peripheral flange 46. Top 10, when in the first position thereof, fits into the collar 8, with top wall 28 of top 10 abutting the upper flange 44 of the collar 8, with the bottom wall 30 of the top abutting the lower flange 46 of collar 8, and with side walls 32 of the top in friction fit with an inner surface of the collar.

In a preferred arrangement of the present invention, the second portion 26 of the lid 12 is flexibly and hingedly connected to the first portion 24 by means of a reduced thickness portion 48 of lid 12.

In a preferred use of the present invention, the bag 6 of the package 2 is adapted to contain and dispense a web 50 of towels which are separably connected by perforations. The dispensing opening 18 has a size sufficient to enable, when the package is in the condition shown in FIG. 4, fingers of a consumer to extend through dispensing opening 18 to grasp a first towel of the web of towels and then to pull such first towel toward and into slit 20, 22. Such slit has a size and shape such that, upon pulling a towel outwardly of the bag 6 and through collar 8 and then through the slit, side edges of the slit apply sufficient tension on the towel being pulled through the slit to cause separation of such towel from a succeeding towel of the web 50 at the perforations, whereby such succeeding towel then will be partially extended through the slit.

Although the use and operation of the closure unit and package are believed to be apparent from the above discussion, such operation now will be described briefly.

Thus, with the lid 12 and top 10 in the opened conditions thereof, as shown in FIG. 5, a web of towels or other articles may be inserted through collar 8 and into bag 6.

Flexible connecting hinge 14 then is bent and top 10 is inserted into collar 8, as shown in FIG. 4. In this position, a first or leading towel may be grasped through the dispensing opening 18 and pulled into the slit 20, 22. Thereafter, the lid 12 is inserted into the recess in the top 10, by means of flexible connecting hinge 16, whereby the unit is in the position shown in FIGS. 1 and 2. This position completely seals the interior of the package. At such time as it is desired to dispense a towel, second portion 26 of the lid 12 may be pivoted upwardly due to the arrangement of reduced thickness portion 48, to the position shown in FIG. 3. A particular towel which partially extends through the slit may be pulled out, with the result that the next following towel then will partially extend through the slit. After the dispensing operation is completed, the second portion 26 of the lid may be returned to its closed position, as shown in FIGS. 1 and 2 of the drawings.

Although a preferred embodiment of the present invention has been described and illustrated, it is to be understood that various modifications may be made to the specifically described and illustrated arrangement without departing from the scope of the present invention. Furthermore, it is apparent that it is intended that the collar 8, top 10 and lid 12 be formed of generally rigid material, for example of high density polyethylene, or other similar materials as will be apparent to those skilled in the art. Furthermore, bag 6 may be formed of any particular material as will be understood by those skilled in the art. Additionally, although the fit of lid 12 into the recess of top 10 and the fit of top 10 into collar 8 have been described with regard to friction fits, it is to be understood that other structural retaining means, as will be understood by those skilled in the art, may be employed. For example, the fitting faces of the respective elements may be inclined. Also, it would be possible that one of the fitting faces might have a projection which may fit into a corresponding recess in the other respective face. Generally, it is intended that the elements fit in a generally moisture retaining and airtight manner sufficient to prevent undue evaporation of the moisture of moisturized towels. Furthermore, it is intended that the manner of fit of the respective elements may be as disclosed in Applicant's U.S. Pat. No. 4,462,507, Additionally, it is intended to be within the scope of the present invention to provide the connecting flaps or hinges 14, 16 of smaller size than illustrated in the drawings. Still further, it will be apparent that the present invention has been illustrated with a generally elongated sixsided configuration. It is to be understood that other configurations, such as oval or round, are contemplated as being within the scope of the present invention. However, since the present invention is contemplated as being of a size and shape to fit into a pocket or purse, a generally elongated or flattened configuration is preferable.

I claim:

1. A dispensing package for containing and dispensing articles, said package comprising:

a flexible bag adapted to contain articles to be dispensed, said bag having a closed first end and an open second end;

a collar fixed to said open second end of said bag, said collar including an upper outwardly extending peripheral flange and a lower inwardly extending peripheral flange;

a top including a top wall having therein a recess defined by a bottom wall and a side wall joining said bottom wall to said top wall, said bottom wall having therein a dispensing opening and a slit connected with said dispensing opening, said top being selectively movable between a first position fitted to said collar and a second position removed from said collar, said top, when in said first position thereof, fitting into said collar with said top wall of said top abutting said upper flange of said collar and with said bottom wall of said top abutting said lower flange of said collar;

a lid selectively movable between a first position fitting into said recess in said top and covering at least a portion of said top and a second position removed from said top; and said lid including a first portion adapted to cover said dispensing opening when said lid is in said first position thereof, said lid including a first portion adapted to cover said slit when said lid is in said first position thereof, and said second portion of said lid being integrally but flexibly connected to said first portion of said lid, such that when said lid is in said first position thereof said second portion of said lid is selectively pivotable with respect to said first portion of said lid away from said top, thereby to uncover said slit.

2. A package as claimed in claim 1, wherein said collar is fixed to said bag by an adhesive.

3. A package as claimed in claim 1, wherein said collar is fixed by heat sealing to said bag.

4. A package as claimed in claim 1, wherein said first and second portions of said lid have depending therefrom integral flanges which abut said bottom wall of said recess and which friction fit with said side wall when said lid is in said first position thereof.

5. A package as claimed in claim 1, wherein said first portion of said lid has depending therefrom an integral projection which tightly abuts said bottom wall at an area thereof adjacent the juncture between said dispensing opening and said slit when said first portion is in said first position thereof.

6. A package as claimed in claim 1, wherein said first and second portions of said lid include outwardly extending flanges which abut said top wall of said top when said lid is in said first position thereof.

7. A package as claimed in claim 1, wherein when said top is in said first position thereof said side wall of said top is in friction fit with an inner surface of said collar.

8. A package as claimed in claim 1, wherein said collar, said top and said first and second portions of said lid are formed as a single integral member.

9. A package as claimed in claim 8, wherein said single integral member comprises a molded plastic element.

10. A package as claimed in claim 1, wherein said second portion of said lid is integrally connected to said first portion of said lid by a reduced thickness portion of said lid.

11. A package as claimed in claim 1, further comprising a flexible connecting hinge integral with said top and with said collar and connecting said top to said collar.

12. A package as claimed in claim 1, further comprising a flexible connecting hinge integral with said first portion of said lid and with said top and connecting said lid to said top.

13. A package as claimed in claim 1, further comprising a first flexible connecting hinge integral with said top and with said collar and connecting said top to said collar, and a second flexible connecting hinge integral with said first portion of said lid and with said top and connecting said lid with said top.

14. A package as claimed in claim 1, adapted to contain and dispense a web of towels which are separably connected by perforations, wherein said dispensing opening has a size sufficient to enable fingers of a consumer to extend through said dispensing opening to grasp a first towel of the web of towels and to then pull such first towel toward and into said slit, and wherein said slit has a size and shape such that, upon pulling a towel outwardly of said bag and said collar through said slit, side edges of said slit apply sufficient tension on the towel being pulled through the slit to cause separation of such towel from a succeeding towel of the web of towels at the perforations, whereby such succeeding towel will then be partially extended through said slit.

15. A closure unit for a dispensing package of the type for containing and dispensing articles, said unit comprising:

a collar adapted to be fixed to an open end of a bag adapted to contact articles to be dispensed, said collar including an upper outwardly extending peripheral flange and a lower inwardly extending peripheral flange;

a top including a top wall having therein a recess defined by a bottom wall and a side wall joining said bottom wall to said top wall, said bottom wall having therein a dispensing opening and a slit connected with said dispensing opening, said top being selectively movable between a first position fitted to said collar and a second position removed from said collar, said top, when in said first position thereof, fitting into said collar with said top wall of said top abutting said upper flange of said collar and with said bottom wall of said top abutting said lower flange of said collar;

a lid selectively movable between a first position fitting into said recess in said top and covering at least a portion of said top and a second position removed from said top; and said lid including a first portion adapted to cover said dispensing opening when said lid is in said first position thereof, said lid including a second portion adapted to cover said slit when said lid is in said first position thereof, and said second portion of said lid being integrally but flexibly connected to said first portion of said lid, such that when said lid is in said first position thereof said second portion of said lid is selectively pivotable with respect to said first portion of said lid away from said top, thereby to uncover said slit.

16. A unit as claimed in claim 15, wherein said first and second portions of said lid have depending therefrom integral flanges which abut said bottom wall of said recess and which friction fit with said side wall when said lid is in said first position thereof.

17. A unit as claimed in claim 15, wherein said first portion of said lid has depending therefrom an integral projection which tightly abuts said bottom wall at an area thereof adjacent the juncture between said dispensing opening and said slit when said first portion is in said first position thereof.

18. A unit as claimed in claim 15, wherein said first and second portions of said lid include outwardly extending flanges which abut said top wall of said top when said lid is in said first position thereof.

19. A unit as claimed in claim 15, wherein when said top is in said first position thereof said side wall of said top is in friction fit with an inner surface of said collar.

20. A unit as claimed in claim 15, wherein said collar, said top and said first and second portions of said lid are formed as a single integral member.

21. A unit as claimed in claim 20, wherein said single integral member comprises a molded plastic element.

22. A unit as claimed in claim 15, wherein said second portion of said lid is integrally connected to said first portion of said lid by a reduced thickness portion of said lid.

23. A unit as claimed in claim 15, further comprising a flexible connecting hinge integral with said top and with said collar and connecting said top to said collar.

24. A unit as claimed in claim 15, further comprising a flexible connecting hinge integral with said first portion of said lid and with said top and connecting said lid to said top.

25. A unit as claimed in claim 15, further comprising a first flexible connecting hinge integral with said top and with said collar and connecting said top to said collar, and a second flexible connecting hinge integral with said first portion of said lid and with said top and connecting said lid with said top.

26. A unit as claimed in claim 15, adapted for use with a package to contain and dispense a web of towels which are separably connected by perforations, wherein said dispensing opening has a size sufficient to enable fingers of a consumer to extend through said dispensing opening to grasp a first towel of the web of towels and to then pull such first towel toward and into said slit, and wherein said slit has a size and shape such that, upon pulling a towel outwardly of said bag and said collar through said slit, side edges of said slit apply sufficient tension on the towel being pulled through the slit to cause separation of such towel from a succeeding towel of the web of towels at the perforations, whereby such succeeding towel will then be partially extended through said slit.

* * * * *

UNITED STATES PATENT AND TRADEMARK OFFICE

CERTIFICATE OF CORRECTION

PATENT NO. : 4,526,291

DATED : July 2, 1985

INVENTOR(S) : Herman Margulies

It is certified that error appears in the above-identified patent and that said Letters Patent is hereby corrected as shown below:

Column 6, Claim 1, line 22 , "first" should read -- second --.

Signed and Sealed this

*Twentieth* Day of *May 1986*

[SEAL]

*Attest:*

DONALD J. QUIGG

*Attesting Officer*

*Commissioner of Patents and Trademarks*